United States Patent [19]

Ratelband

[11] 4,170,799

[45] Oct. 16, 1979

[54] SWIMMING APPARATUS

[76] Inventor: Johannes B. Ratelband, Utrechtsestraat 55-34, Arnhem, Netherlands, 6811 LV

[21] Appl. No.: 845,734

[22] Filed: Oct. 26, 1977

[30] Foreign Application Priority Data

Oct. 27, 1976 [NL] Netherlands ..... 7611925

[51] Int. Cl.[2] ..... A63B 69/12; A63B 31/00

[52] U.S. Cl. ..... 4/172; 4/172.15; 35/29 B; 272/71

[58] Field of Search ..... 4/172, 172.11, 172.15, 4/185 R, 185 AB; 35/29 B; 128/25 R, 369; 272/71, 144

[56] References Cited

U.S. PATENT DOCUMENTS

| | | | |
|---|---|---|---|
| 2,035,835 | 3/1936 | Raber | 4/172 |
| 3,112,928 | 12/1963 | Oswald | 272/71 |
| 3,445,941 | 5/1969 | Eaves et al. | 35/29 B |
| 3,512,416 | 5/1970 | Hohwart | 272/71 |
| 3,966,202 | 6/1976 | Cynamon | 35/29 B |

*Primary Examiner*—Richard R. Stearns

*Attorney, Agent, or Firm*—Snyder, Brown & Ramik

[57] ABSTRACT

A swimming apparatus of restricted dimensions comprising a basin and a supporting device is provided, the supporting device being supported in the basin and having members for engaging a swimmer's trunk while being pivotable about at least two horizontal orthogonal axes in order to allow the swimmer mobility while keeping his center of gravity fixed.

12 Claims, 2 Drawing Figures

SWIMMING APPARATUS

BACKGROUND OF THE INVENTION

1. Field of the Invention

The invention relates to a swimming apparatus comprising a basin and a supporting device having members engaging the trunk of a swimmer, for example formed by a belt or two clamps movable towards and away from one another.

2. Prior Art

Such a device is known in the form of a swimming pool and a so-called angling rod. This angling rod comprises a belt for the swimmer with a cable suspended to a pole or to a crab travelling on a rail over the pool. Such a device requires a large space, a large quantity of water and hence much energy for heating water, whilst due to the unavoidable backlash of the cable many hydrophobe persons will not feed at ease. Moreover the suspension of a swimmer to a cable has the disadvantage that during a discontinuous advance like in the case of the breast stroke a troublesomely changing upward force is experienced.

SUMMARY OF THE INVENTION

In accordance with this invention there is provided a device of the kind set forth which is characterized in that the supporting device is firmly fixed in the basin and the members engaging the swimmer's trunk are adapted to turn at least about two orthogonal horizontal axes with respect to the basin. These engaging members are preferably rotatable, in addition, about a third, vertical axis.

PREFERRED EMBODIMENTS

In a simple, compact, practically satisfying embodiment the supporting device is provided with a base member to which a supporting member is secured, in which member an annular member is rotatable about a horizontal axis, said annular member supporting at least two clamping members adapted to move towards and away from one another and to turn about a common horizontal axis at right angles to the first-mentioned horizontal axis. The supporting member is preferably pivotably secured to the base member so as to be rotatable about a vertical axis.

A disturbance-free embodiment of the rotatable fixation of the annular member in the supporting member, which embodiment can be manufactured and maintained in a simple manner, is obtained when the supporting member is formed by a member disposed in a vertical plane and adapted to turn through at least 60% of a circle, said member having inwardly extending flanges between which the annular member is rotatably journalled.

In order to allow easy movement of the annular member in the supporting member, the annular member is provided on the outer side with a plurality of uninterrupted rubber strips fixed thereto by vulcanisation. In order to minimize the consequences of bumping on the various parts it is advisable to round off the supporting member and the annular member both on the inner and outer sides. The movability of the engaging members in the annular members can be obtained in a very simple manner by providing the annular member on the inner side with approximately diametrically opposite fastening members to which a belt is secured. This movability may even be enhanced by attaching in a rotatable manner the fastening members to the annular member, which fastening members may specifically have the shape of rings fittingly receiving snap-hooks of the belt.

Particularly if the swimming apparatus is to be used for physiotherapeutic purposes, it may be desirable to cause the swimmer to perform movements in a defined position. For this purpose the supporting member can be fixed in place with respect to the base member and the annular member with respect to the supporting member.

In order to facilitate displacement and storage of the swimming apparatus, the base member is secured to the bottom of a pool of flexible material having a hollow inflatable wall.

Whilst complete mobility of the swimmer is maintained, his centre of gravity can be held at a fixed place by the apparatus embodying the invention, so that an extremely small basin may be employed. For example, a basin for adults requires only a diameter of 2.5 meters and a depth of 1 meter since a water depth of 80 centimeters is already sufficient. A spherical segment is a very suitable shape for the basin.

Apart from the said advantages the swimming apparatus according to the invention provides some additional advantages. In hospitals and similar establishments where the risk of infection is high, there will not be appreciable objection in renewing the comparatively small quantity of water by a fresh quantity of tap water with any additives, if necessary after cleaning the basin and the supporting device with a disinfectant.

Thanks to the limited dimensions the swimming apparatus can be used outdoor in summer and be transferred to an indoor space in winter, which is particularly attractive for recreation purposes.

The transport cost of this swimming apparatus is comparatively low so that even for export the sales may be kept comparatively low, whilst the swimming device can be delivered as a ready product, which is economically installed and which can be industrially manufactured in series.

The invention will be described more fully with reference to the drawing showing a preferred embodiment of the swimming apparatus of the invention.

Figure 1:
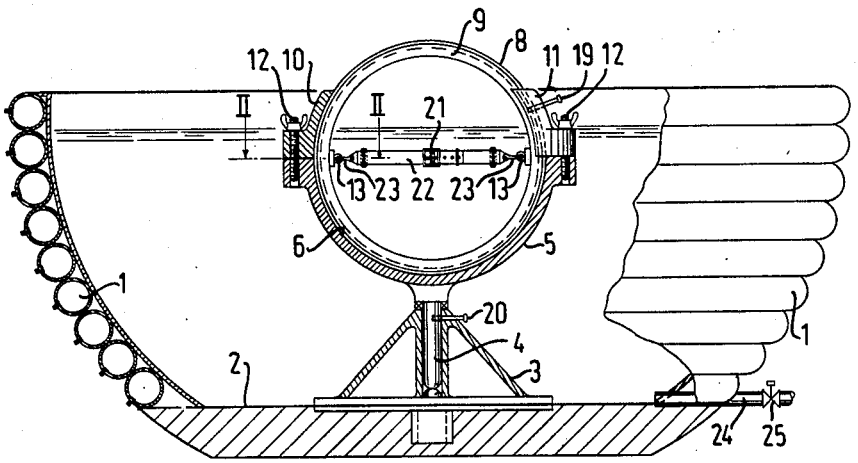
FIG. 1 is a vertical sectional view of a swimming apparatus embodying the invention.
Figure 2:
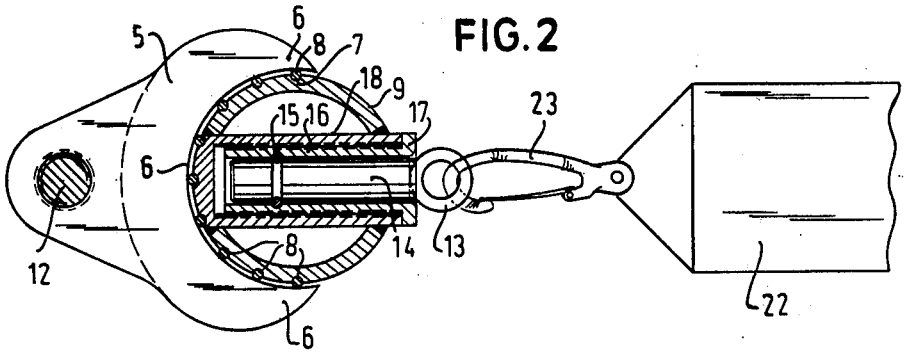
FIG. 2 is an enlarged, partial sectional view taken on the line II—II in FIG. 1.

Referring to the sectional view of FIG. 1 the swimming apparatus comprises a basin 1 in the shape of a spherical segment and a supporting device having members for engaging a swimmer. The supporting device is secured to the bottom 2 of the basin 1 with the aid of a base member 3 having a flaring base. This base member 3 has a vertical bore having a convex bottom in which a trunnion 4 is rotatably fitting. This trunnion 4 carries a supporting member 5 formed by a horse-shoe member disposed in a vertical plane, the gap opening upwardly. The horse-shoe member is provided with inwardly extending flanges 6 so that in a cross-sectional view a C-shaped profile as shown in the sectional view of FIG. 2 is obtained.

Between the flanges is enclosed the annular member 9 formed by a circularly curved tube. On the outer side the annular member 9 has grooves 7, in which uninterrupted rubber strips 8 are fixed by vulcanisation so that a low-friction bearing in the supporting member 5 is obtained.

The annular member 9 can be inserted from above into the horse-shoe supporting member 5 and be subsequently locked therein by fastening the two free ends 10 and 11 of the horseshoe member to the lower part by screwing bolts 12 through bores in the two ends 10 and 11 into tapped holes in the lower part of the supporting member 5.

The annular member is provided at diametrically opposite places with inwardly extending rings 13. These rings 13 have each a pin 14, an uninterrupted groove of which receives an O-ring 15, which rotatably retains the pin 14 in a bush 16 provided with a collar 17. Said bush 16 has external screwthread fitting in the internal screwthread of a sleeve 18, which is fastened in a radial direction in the annular member 9.

As a matter of course, the rings 13 may, as an alternative, be directly welded to the annular member 5, but this is not conducive to the movability, whilst repairs would cause more trouble.

In the supporting member 5 and in the base member 3 are slidably arranged pins 19 and 20 respectively provided with knobs and fitting in recesses in the annular member 9 and in the trunnion 4 respectively; upon depression said pins prevent movement of the annular member and of the trunnion.

The members engaging the user of the swimming device are formed by a belt 22 provided with a suitable clasp 21 and having snap-hooks 23 at two approximately diametrically opposite places. These snap-hooks are detachably hooked into the eyelets 13 and even if the eyelets are rigidly secured to the annular member 9 said hooks allow a given amount of movement of the belt 22 around the axis passing through the two eyelets 13.

The basin may be made from a suitable synthetic material for example, polyester reinforced by glass fibre or in a sandwich structure, whilst as an alternative a flexible sheet-like synthetic resin may be used for the manufacture of the basin, in which case the upright walls may be hollow and inflatable.

For use in hospitals and suchlike institutions it is preferred to use a stainless steel basin for hygienic reasons.

The basin is provided in a conventional manner with a drain opening 24 provided with a suitable plug 25. If desired the basin may be provided with a heating device, which may include a thermostat.

It will be obvious that apart from the embodiment shown various other structures may be conceived within the scope of the invention.

What is claimed is:

1. Apparatus for allowing a person to swim within a confined area, comprising in combination:

a basin adapted to be filled with water to a predetermined level; and an upstanding support assembly fixed substantially centrally within said basin, said support assembly including first means engageable about a user's waist for allowing movement about a first axis passing transversely through the user's body, and second means pivotally mounting said first means about a fixed horizontal axis orthogonal to said first axis, said first means being positioned substantially at said predetermined level to allow the user freely to swim and third means mounting said second means for movement about a vertical axis, said first axis and said vertical axis being contained substantially in a common vertical plane.

2. Apparatus as defined in claim 1 wherein said basin comprises a rigid base member and an inflatable side wall.

3. Apparatus as defined in claim 2 wherein said basin is substantially semi-spherical.

4. Apparatus as defined in claim 1 wherein said basin comprises a rigid base member and a inflatable side wall.

5. Apparatus as defined in claim 4 wherein said basin is substantially semi-spherical.

6. Apparatus as defined in claim 1 wherein said support assembly also includes a rigid base fixed to the bottom of said basin and to which said second means is directly connected.

7. Apparatus as defined in claim 1 characterized in that said third means comprises a base member secured to the bottom of the basin and a semi-annular supporting member pivotally secured about said vertical axis at its bottom to said base member, said semi-annular member being open at its top and having a recess extending radially outwardly from its inner surface, said second means comprising an annular member slidably received within said recess and being rotatable about said fixed horizontal axis, and said first means comprising at least two fastening members extending radially inwardly from said annular member, said fastening members being located substantially diametrically opposite each other and adapted to be movable toward and away from one another and rotatable about said first axis.

8. A swimming apparatus as claimed in claim 7 characterized in that each of said fastening members has attached thereto one side of a belt which is adapted to engage the user's waist.

9. A swimming apparatus as claimed in claim 7 characterized in that the supporting member is formed by a member disposed in a vertical plane and covering at least 60% of a circle and having inwardly extending flanges between which the annular member is rotatably journalled.

10. A swimming apparatus as claimed in claim 9 characterized in that on the radially outer side the annular member is provided with a plurality of uninterrupted rubber strips fixed thereto by vulcanisation.

11. A swimming apparatus as claimed in claim 7 characterized in that the supporting member and the annular member are rounded off both on the inner and the outer sides.

12. A swimming apparatus as claimed in claim 7 characterized in that the supporting member can be fixed in place with respect to the base member and the annular member with respect to the supporting member.

* * * * *